US010392158B2

(12) United States Patent
Bratsch et al.

(10) Patent No.: US 10,392,158 B2
(45) Date of Patent: Aug. 27, 2019

(54) METHOD FOR PRODUCING A LID WITH CLOSURE

(71) Applicant: XOLUTION GMBH, München (DE)

(72) Inventors: Christian Bratsch, Salzburg (AT); Marc Von Rettberg, München (DE)

(73) Assignee: XOLUTION GMBH, München (DE)

( * ) Notice: Subject to any disclaimer, the term of this patent is extended or adjusted under 35 U.S.C. 154(b) by 669 days.

(21) Appl. No.: 14/917,658

(22) PCT Filed: Sep. 12, 2014

(86) PCT No.: PCT/EP2014/069472
§ 371 (c)(1),
(2) Date: Mar. 9, 2016

(87) PCT Pub. No.: WO2015/036525
PCT Pub. Date: Mar. 19, 2015

(65) Prior Publication Data

US 2016/0221713 A1 Aug. 4, 2016

(30) Foreign Application Priority Data

Sep. 13, 2013 (EP) ..... 13184385
Sep. 17, 2013 (EP) ..... 13184833

(51) Int. Cl.
*B21D 51/44* (2006.01)
*B65D 17/50* (2006.01)
*B65D 47/28* (2006.01)

(52) U.S. Cl.
CPC ..... *B65D 17/506* (2013.01); *B21D 51/44* (2013.01); *B65D 47/286* (2013.01); *B65D 2517/0041* (2013.01); *B65D 2517/0094* (2013.01)

(58) Field of Classification Search
CPC ..... B21D 51/44; B65D 17/506; B65D 2517/0041; B65D 2517/0094; B65D 47/286
See application file for complete search history.

(56) References Cited

U.S. PATENT DOCUMENTS

| | | | |
|---|---|---|---|
| 4,170,724 | A | 10/1979 | Waterbury |
| 7,591,389 | B2 | 9/2009 | Wong |
| 7,611,029 | B2 | 11/2009 | Wong |
| 7,891,517 | B2 | 2/2011 | Simmons |
| 2007/0170184 | A1 | 7/2007 | Canedo |

(Continued)

FOREIGN PATENT DOCUMENTS

EP 1247752 A1 * 10/2002 ..... B65D 17/506

*Primary Examiner* — Pradeep C Battula
(74) *Attorney, Agent, or Firm* — Dykema Gossett PLLC

(57) ABSTRACT

The invention relates to a method with the following steps: provision of a lid panel with a pouring opening and at least one guide opening, preferably with two guide openings; bringing together of an inner slide piece and a side of the lid panel that is provided as container inner face; bringing together of an outer slide piece and a side of the lid panel that is provided as a container outer face; connection of the inner with the outer slide piece via at least one connection element arranged at least partially in the at least one guide opening; bringing together a closure element and the side of the lid panel that is provided as a container inner face with the inner slide piece; and producing a coupling between the closure element and the inner slide piece.

19 Claims, 5 Drawing Sheets

(56) References Cited

U.S. PATENT DOCUMENTS

| | | | |
|---|---|---|---|
| 2009/0133593 | A1 | 5/2009 | Till |
| 2010/0133275 | A1 | 6/2010 | Phillips |
| 2011/0006062 | A1 | 1/2011 | Bratsch |
| 2013/0320013 | A1 | 12/2013 | Bratsch |

* cited by examiner

METHOD FOR PRODUCING A LID WITH CLOSURE

FIELD OF THE INVENTION

The invention relates to a method for producing a lid with closure for a container, in particular for a beverage can.

STATE OF THE ART

A lid for a can that has a closure that can be closed in multiple ways is known from the state of the art. The purpose of the invention consists of providing an efficient production method for a lid with closure. In particular, the method should be able to run automatically in order to produce large item numbers.

DESCRIPTION OF THE INVENTION

The invention provides a method for production of a lid with closure for a container, in particular a beverage can, according to claim 1. The method according to the invention comprises the following steps: provision of a lid panel with a pouring opening and at least one guide opening, preferably with two guide openings; bringing together of an inner slide piece and a side of the lid panel that is provided as container inner face; bringing together of an outer slide piece and a side of the lid panel that is provided as a container outer face; connection of the inner with the outer slide piece via at least one connection element arranged at least partially in the at least one guide openings; bringing together a closure element and the side of the lid panel that is provided as a container inner face with the inner slide piece; and producing a coupling between the closure element and the inner slide piece.

Here, the lid element that has the pouring opening and the at least one guide opening, without further lid elements that are attributable to the closure, is called lid panel. In case of a beverage can, the lid panel is for example a round aluminum or tin plate and has a flanged edge by means of which the lid can be attached to a cylindrical can base body. The unit of the connected inner and outer slide piece is also referred to as actuating element.

The pouring opening is the opening of which the content can be poured out during use of the container. In case of a beverage can, this is the drinking opening.

The guide opening of which at least one, though preferably two are provided is used to guide the inner and outer slide pieces that are connected to each other as a unit. The guide openings can for example be formed in a slit-shaped way so that for instance connection pins are guided in them between the inner and the outer slide piece in order to enable shifting of the unit along the slits. The guide openings ensure the required movement leeway for the connection pins; the actual guiding system is constructively produced essentially between the closing element and the inner slide piece of the actuating element. To provide for as little direct contact as possible (or no direct contact at all) between the lid panel and the connection pin(s), for example to avoid abrasion and notching of them, the guiding slit and/or the guiding slits are released more broadly than the expansion of the connection pins transversally to their movement direction. During assembly, guiding is ensured by the mechanical system of the assembling facility. The inner guide piece is disposed on the side of the lid that should work as a part of the container inner face; this side will also be referred to as lid inner face in the following. The outer guide piece is disposed on the side of the lid that should work as a part of the container outer face; this side will also be referred to as lid outer face in the following.

Also the closure element is located on the lid inner face. The closure element has a sealing effect in a closing position between the container inner face and the container outer face. In particular, openings in the lid panel are sealed in the closing position for example by means of one or multiple seals. The closure element is coupled with the inner sliding element. The closure element is moved by means of moving the unit of inner and outer slide piece. In a closing position of the closure element, said unit of inner and outer slide piece is in an appropriate closing position (e.g. on one end of the guiding slit(s)). In an open position of the closure element, said unit is in an appropriate open position (e.g. on another end of the guiding slit(s)). In case of a beverage can with carbonated liquid, a gas pressure is created, which presses the closure element against the lid inner face, in addition to the mechanically generated pressing force during movement of the actuating element.

The material the inner and outer slide piece are made of preferably comprises plastic. The material the closure element is made of also comprises plastic but can in particular comprise two different plastics, whereby one of the plastics can work as a sealing material for sealing in relation to the lid panel.

A further development of the method according to the invention consists in that the step of bringing together the first slide piece and the side of the lid panel that is provided as a container inner face can comprise the following step: alignment of the relative position of the inner slide piece and the lid panel, in particular with regard to the at least one guide opening. The advantage consists in that for example an alignment takes place as a consequence, which facilitates a connection and that in particular elements to be provided (e.g. pins, holes) are aligned for connection with the outer sliding element with regard to the guide opening. Optionally, the following further step can be provided in addition: alignment of the inner slide piece into a predefined position, in particular through feeding and inserting in a cavity of a work piece carrier. Such a cavity in a work piece carrier ensures fixation of the desired position. With the work piece carrier, one or multiple homogeneous lid components can be led through an installation, in which the steps according to the invention can run in an automated way different manufacturing stages.

According to another further development of the method according to the invention or of the further development already mentioned, the step of aligning the relative position of the inner slide piece and the lid panel can take place through turning of the lid panel. Preferably, a rotary orientation detection by means of a camera or mechanically takes place in this process. The camera can be part of a camera system that can further comprise an evaluation unit in form of a computer or a computer program running on it. Optionally, the following further step can be provided for: inserting of the aligned lid panel in the work piece carrier with the inserted inner slide piece.

Another further development of the method according to the invention or of one of the further developments already mentioned consists in that the step of bringing together the outer slide piece and the side of the lid panel that is provided as a container outer face can comprise positioning of the outer slide piece onto the lid panel. This positions the outer slide piece in relation to the lid panel and also in relation to the inner slide piece. Also, a previous alignment of the outer slide piece, in particular in relation to the at least one guide opening, occurs preferably in this context.

According to another further development of the method according to the invention or to one of the further developments already mentioned, the at least one connection element can comprise at least one—preferably formed as one piece with the outer slide piece—pin, and the step of bringing together the inner with the outer slide piece can comprise inserting of the pin into a respective opening of the inner slide piece, or the at least one connection element can comprise at least one pin that is preferably formed as one piece with the inner slide piece, and the step of bringing together the inner with the outer slide piece can comprise inserting of the pin into a respective opening of the outer slide piece.

Another further development of the method according to the invention or of one of the further developments already mentioned consists in that the step of bringing together the inner and the outer slide piece can comprise riveting and/or welding of the at least one connection element, preferably by means of ultrasound; whereby in combination with the further development described before, riveting and/or welding of a free end of the pin on and/or with an edge of the respective opening of the inner and/or outer slide piece can occur.

According to another further development of the method according to the invention or of one of the further developments already mentioned, the connection of the closure element and the side of the lid panel provided as a container inner face with the inner slide piece can comprise the following steps: inserting of the closure element in a respective recess in the or in one further work piece carrier; and positioning of the lid panel with the connected inner and outer slide pieces.

Another further development of the method according to the invention or of one of the further developments already mentioned consists in that the step of producing a coupling between the closure element and the inner slide piece can comprise the following step: inserting of at least one slide nose of the inner slide piece into a groove of the closure element. Preferably the following further step is implemented: shifting of the slide nose in the groove of the closure element through shifting of the connected inner and outer slide pieces. Through shifting of the slide nose in the groove of the closure element, a coupling between the closure element and the inner slide piece can occur so that the closure element is kept on the lid. The groove can in particular be formed in a way that it is positioned in an oblique way between the closure element and the inner slide piece in case of an accomplished coupling. Hence, the closure element can be pressed onto the inner lid face through shifting of the slide nose because the slide nose drags the closure element near.

According to another further development of the method according to the invention or of one of the further developments already mentioned, the closure element can have a ventilation opening, and the lid panel can preferably have a ventilation recess that is aligned with the ventilation opening when the closure element and the lid panel are brought together, and whereby the method can comprise the following further steps: wetting of the ventilation opening in the closure element with an oil, preferably E900 (polydimethylsiloxane) or silicone oil; and inserting of a pin, which is disposed on a hinged piece section of the outer slide element, in the ventilation opening through folding of the hinged piece section on the outer side of the lid panel. The ventilation opening is wetted with an oil so that the pin can be installed on the hinged piece section in the ventilation opening with a low resistance. The ventilation opening preferably has a circular seal that interacts in a form-fitting way with the pin that is preferably formed with a circular cross-section in order to close the ventilation opening in a gas- and liquid-tight manner.

Another further development of the method according to the invention or of a further development already mentioned consists in that the lid panel can further have at least one riveting opening, preferably two riveting openings, and that bringing together the closure element and the lid panel can comprise the following steps: inserting of the respective riveting pin (or welding pin) of the closure element in the at least one riveting opening (referred to as welding pin opening in case of a welding pin) of the lid panel; and riveting (welding) of the at least one riveting pin (welding pin) on the outer side of the lid panel. The following further step can be provided for: inserting of the respective riveting pin (welding pin) of the closure element in a respective riveting pin input (welding pin input) of a part of the outer slide piece that can be detached during opening of the closure, whereby riveting (welding) of the at least one riveting pin (welding pin) comprises riveting (welding) with the respective riveting pin input (welding pin input). During opening of the closure, the detachable part of the outer slide piece, whereby the detachable part can be situated in particular on the hinged piece section, is left in the position fixed by the riveting pins (welding pins) when the outer slide piece is moved, in particular when the hinged piece section is flipped open. In case of an existing ventilation opening, the pin of the hinged part that is situated in such opening is pulled out of the ventilation opening and a pressure compensation can take place between the inner and outer area of the can.

According to another further development of the method according to the invention or of one of the further developments already mentioned, the following further step can be implemented: positioning of a safety tape, which breaks during opening of the closure, onto the outer slide piece; whereby riveting (welding) of the at least one riveting pin (welding pin) can comprise riveting (welding) of the safety tape with the at least one riveting pin (welding pin), in particular also riveting (welding) with the respective riveting pin input (welding pin input); and whereby preferably at least two riveting pins (welding pins) are to be provided and whereby riveting (welding) of the at least two riveting pins (welding pins) can comprise riveting (welding) of the safety tape with the at least two riveting pins (welding pins). The safety tape can for example be a transparent or colored plastic tape and/or a transparent or colored plastic film. The safety tape is disposed in a way that it breaks when the closure is opened for the first time and therefore tells a user that a first opening has already taken place. In particular, the safety tape can be installed above the hinged part of the outer slide piece. The safety tape can only be laid over the outer slide piece and not be attached to it directly. Alternatively, however, it can be connected directly to the outer slide piece, e.g. in cases where only one riveting pin (welding pin) is to be provided for.

Another further development of the method according to the invention or of one of the already mentioned further developments consists in that the following further step can be provided for: verification of the position of the weldings and the at least one riveting pin and/or verification of the position of the riveting inputs and/or verification of the position of the safety tape with a camera, in particular with an evaluation unit. Preferably, the following further step can be implemented: check of the outer slide piece and/or the lid panel and/or the edge of the lid panel for damages and correct assembly with the camera, in particular with the evaluation unit.

According to another further development of the method according to the invention or of one of the further developments already mentioned, the following further step can be implemented: application of pressure to the lid by means of a gas for verification of the tightness of the lid for at least one pressure value, preferably for two different pressure values. The test of two different pressure values can take place at a comparatively low pressure and at a comparatively high pressure, whereby different stresses onto the seals can be tested.

Another further development of the method according to the invention or of one of the further developments already mentioned consists in that the provision of a lid panel can comprise the following step: bulging of an inner area of the lie, panel into a convex form in relation to the outer side. The step of punching the openings in the lid panel can preferably take place before. The outward bulging process has the advantage that the closure element will continue to close and seal reliably even after a potential deformation during pressurization from the inner face of the container. A further advantage is the uniform dimensionally stable formation of the lid panel (calibration of the lid panel) that can otherwise form differently in a flat initial shape in the course of the lid production.

According to another further development of the method according to the invention or of one of the further developments already mentioned, the following further step can be implemented: collection of the lids in a stack. The following further step is preferably implemented: packaging of the lid stack if there is a predetermined number of lids in the lid stack.

In addition, an application, in particular printing, of a label can be included. The label can enable retracing of the lid and/or be used for marketing purposes and/or contain special information such as to mark deposit systems or to provide information about the alcohol content.

Furthermore, there can also be an additional check of the punched lid panel in order to detect a possibly existing ridge, whereby lid panels with a bad evaluation can be sorted out. Alternatively, already punched and calibrated lid panels can be supplied.

Finally, the method according to the invention or one of the further developments already mentioned can comprise a measurement and/or recording of assembly forces or torques. Therefore, quality assurance can be provided. For example, the forces during compression of the inner and outer sliding element or during closing of the hinged part can be within a certain range of values, which has been determined empirically, for intact elements. Then, it can be concluded from an upward or downward deviation of a value (outside of the range) that there is a problem. For example, one of the elements could be broken or its alignment is not optimal.

The invention also provides a device that can be used to, implement the steps of the method according to the invention or of one of the further developments.

DESCRIPTION OF THE EMBODIMENTS

FIG. 1 (FIG. 1A to 1F) illustrates the method according to the invention in accordance with a first embodiment.

Figure 1A:
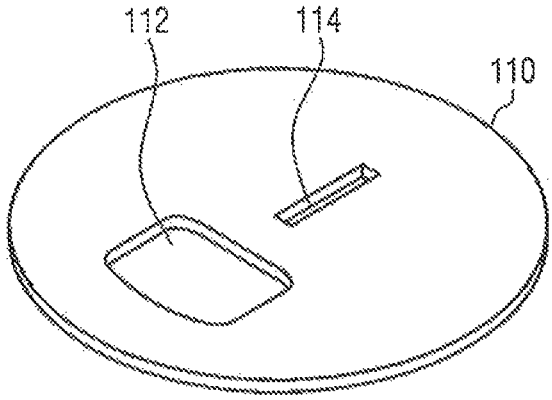
FIG. 1 illustrates the method according to the invention in accordance with a first embodiment.

First, the lid panel 110 is provided in the first step according to FIG. 1A. A pouring opening 112 and a guide opening 114 are provided in it.

Figure 1B:
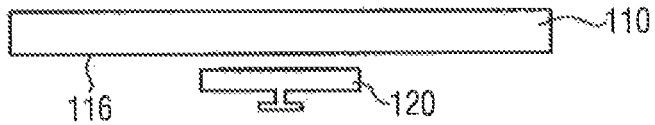

In the next step, bringing together of an inner slide piece 120 and a side of the lid panel 110 that is provided as a container inner face 116 takes place according to FIG. 1B.

Figure 1C:
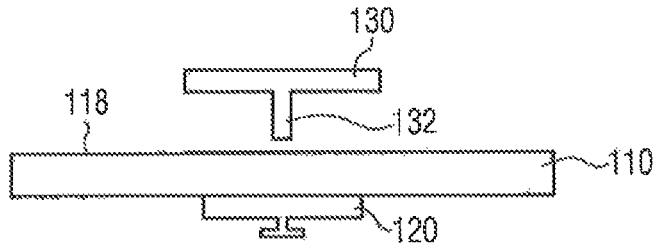

Subsequently, an outer slide piece 130 and a side of the lid panel 110 provided as a container outer face 118 are brought together according to FIG. 1C.

Figure 1D:
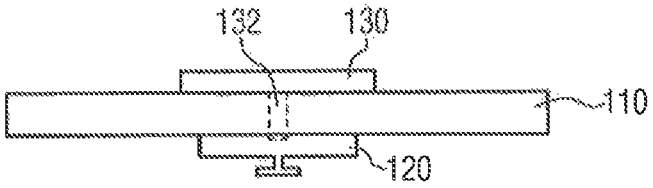

Then, connecting of the inner slide piece 120 with the outer slide piece 130 via at least one connection element 132 disposed through the guide opening 114 takes place according to FIG. 1D.

Figure 1E:
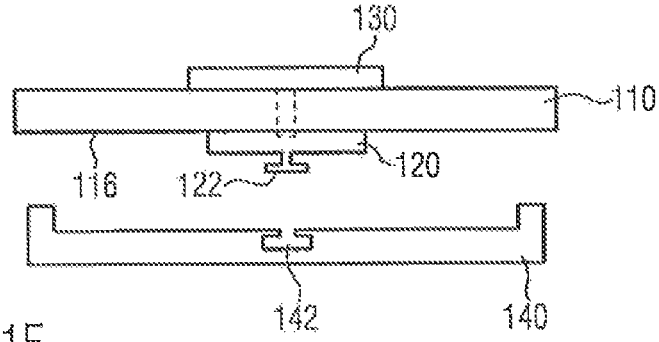

Furthermore, a closure element 140 and the side of the lid panel 110 that is provided as a container inner face 116 will then be brought together with the inner slide piece 120 according to FIG. 1E. The closure element has a groove 142 whose cross-section form is formed in a way that is complementary to a cross-section, form of a slide nose 122 disposed on the inner slide piece 120.

Figure 1F:
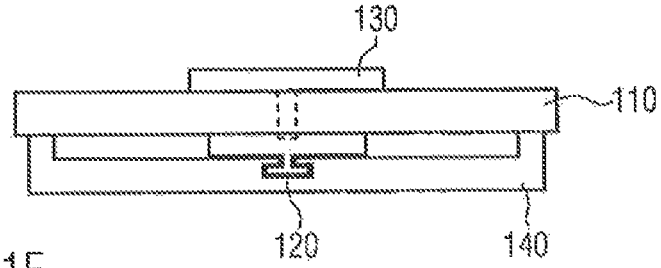

Finally, the establishment of a coupling between the closure element 140 and the inner slide piece 120, in this example via a slide nose 122 that will be inserted in the groove 142 of the closure element, takes place according to FIG. 1F.

FIG. 2 (FIGS. 2A to 2E) illustrates the method according to the invention in accordance with a second embodiment.

Figure 2A:
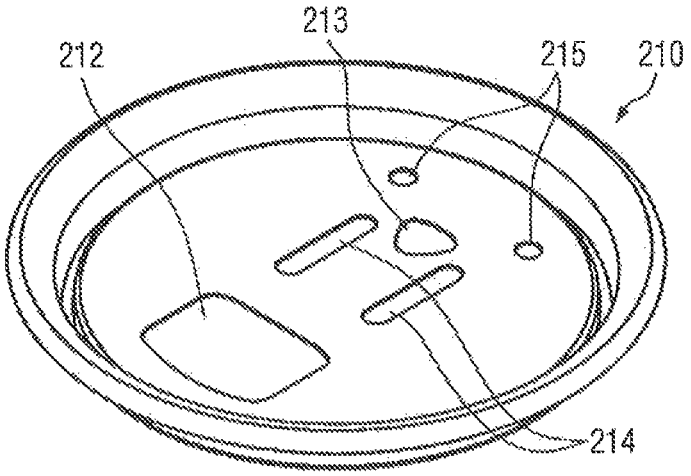
FIG. 2 illustrates the method according to the invention in accordance with a second embodiment.

The provision of the lid panel 210 takes place according to FIG. 2A. The drinking opening 212 and the guiding slits 214 are contained in it. Furthermore, a ventilation recess 213 and two riveting openings 215 are to be provided for.

Figure 2B:
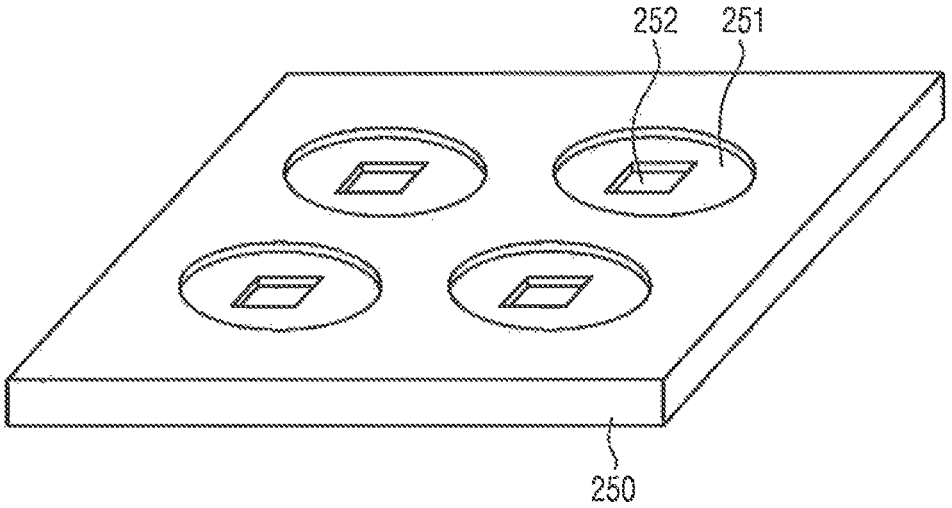

FIG. 2B shows a work piece carrier 250. Troughs 251 are to be provided in it (four troughs in this example) that contain, in turn, cavities 252. In the cavities 252, inner slide pieces can be installed after previous alignment and hence fixed in their position. The troughs 251 can integrate lid panels and/or closure elements.

Figure 2C:
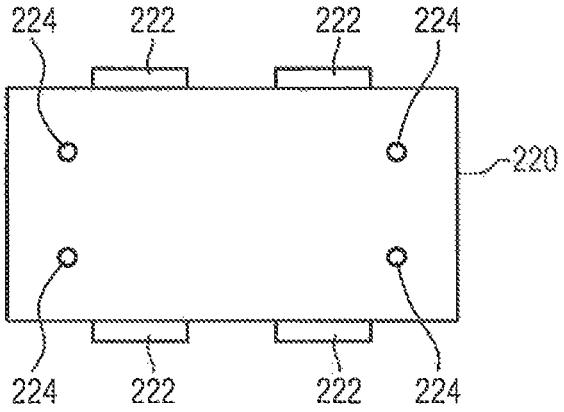

FIG. 2C shows an inner slide piece 220 in a top view that is equipped in this embodiment with four laterally disposed slide noses 222. Furthermore, the inner slide piece 220 has openings 224 in which respective connection pins of an outer slide piece can be inserted.

Figure 2D:
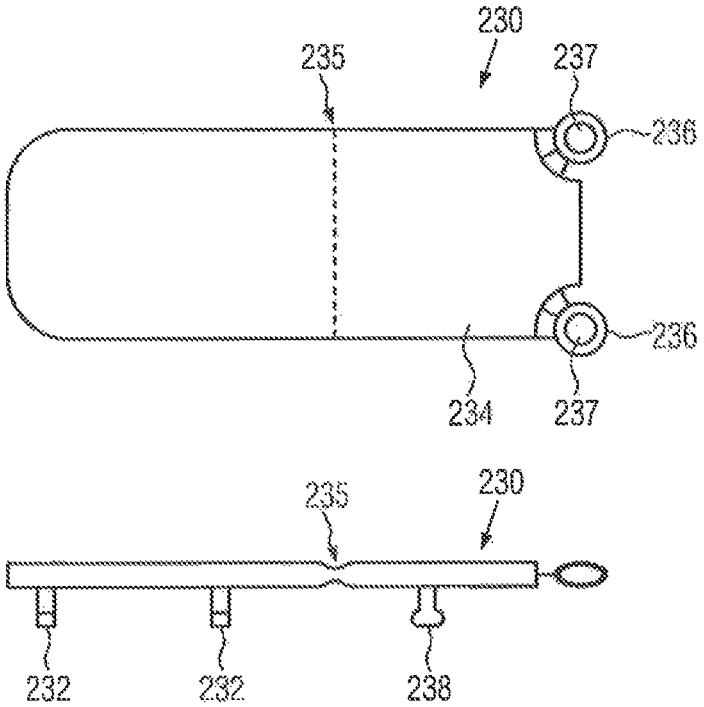

FIG. 2D shows such an outer slide piece 230 in a top view (top) and in a lateral view (bottom). This outer slide piece 230 has pins 232 that can be inserted in the openings 224 of the inner slide piece 220 for the connection process. Further, the outer slide piece 230 comprises a hinged piece section 234 and a pin 238 that is formed on it and that can be integrated in a respective ventilation opening of the closure element. In addition, detachable parts 236 of the outer slide piece 230 are to be provided, which are connected to the hinged piece section 234 via crosspieces. The outer slide piece has a tapered area 235 around which the hinged piece section 234*c* can be folded.

Figure 2E:
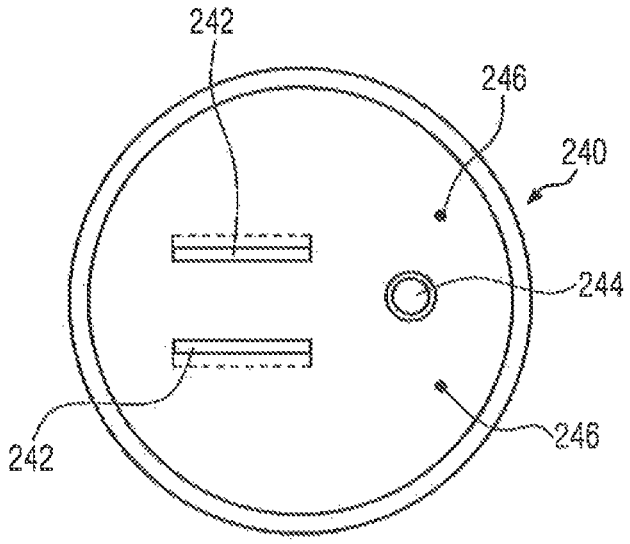

FIG. 2E shows a top view of the closure element 240 that has the groove 242 to integrate the slide noses 222 of the inner slide piece 220. Furthermore, a ventilation opening 244 and two riveting pins 246 are to be provided. During manufacturing of the lid, the riveting pins 246 are connected to each other with the detachable parts 236 of the outer slide piece through welding, e.g. by means of ultrasound. Therefore, they can for example be inserted in openings 237 before.

The invention claimed is:

1. A method for producing a lid with closure for a container comprising the following steps:

provision of a lid panel with a pouring opening and at least one guide opening;

bringing together an inner slide piece and a side of the lid panel that is provided as a container inner face;

bringing together an outer slide piece and a side of the lid panel that is provided as a container outer face;

connecting the inner with the outer slide piece via at least one connection element that is disposed at least partially in the at least one guide opening;

bringing together a closure element and the side of the lid panel that is provided as container inner face with the inner slide piece; and establishment of a coupling between the closure element and the inner slide piece.

2. The method according to claim 1, wherein the step of bringing together the inner slide piece and the side of the lid panel provided as container inner face comprises the following step:

alignment of the relative position of the inner slide piece and the lid panel in relation to the at least one guide opening.

3. The method according to claim 2, wherein the step of alignment takes place by means of turning the lid panel with a further step of detecting a rotary orientation with a camera.

4. The method according to claim 3, further including the following step:

inserting of the aligned lid panel in the work piece carrier with the inserted inner slide piece.

5. The method according to claim 2, further including the following step:

alignment of the inner slide piece into a predetermined position by feeding and inserting in a cavity of a work piece carrier.

6. The method according to claim 1, wherein the step of bringing together the outer slide piece and the side of the lid panel provided as a container outer face comprises positioning of the outer slide piece onto the lid panel.

7. The method according to claim 1, wherein the at least one connection element comprises at least one pin that is formed as one piece with the outer slide piece, and wherein the step of connecting the inner slide piece with the outer slide piece comprises inserting of the pin in a respective opening of the inner slide piece, or wherein the at least one connection element comprises at least one pin that is formed as one piece with the inner slide piece and the step of connecting the inner slide piece with the outer slide piece comprises inserting of the at least one pin in a respective opening of the outer slide piece; and/or wherein the step of connecting the inner with the outer slide piece comprises measurement of a force or a torque.

8. The method according to claim 1, wherein the step of connecting the inner slide piece with the outer slide piece comprises riveting/welding of the at least one connection element, preferably by means of ultrasound;

wherein in combination with riveting/welding of a free end of a pin with an edge of the respective opening of the inner slide piece and/or outer slide piece takes place.

9. The method according to claim 1, wherein the process of bringing together the closure element and the side of the lid panel provided as container inner face with the inner slide piece comprises the following steps:

inserting the closure element in a respective recess in the work piece carrier or in a further work piece carrier; and positioning the lid panel onto the connected inner slide piece and outer slide piece.

10. The method according to claim 1, wherein the step of establishing a coupling between the closure element and the inner slide piece comprises the following step:

inserting at least one slide nose of the inner slide piece in a groove of the closure element.

11. The method according to claim 10, further including the following step:

shifting the slide nose in the groove of the closure element through shifting the connected inner slide piece and outer slide piece.

12. The method according to claim 1, wherein the closure element has a ventilation opening and the lid panel has a ventilation recess that is aligned with the ventilation opening during bringing together the closure element and the lid panel, and wherein the method comprises the following further steps:

wetting of the ventilation opening in the closure element with an oil; and inserting a pin that is disposed on a hinged piece section of the outer sliding element in the ventilation opening through folding of the hinged piece section to the outer side of the lid panel.

13. The method according to claim 1, wherein the lid panel further has at least one riveting opening, and the process of bringing together the closure element and the lid panel comprises the following step:

inserting a respective riveting pin/welding pin of the closure element in the at least one riveting opening of the lid panel; and riveting/welding of the at least one riveting pin/welding pin on the outer side of the lid panel;

with the further step:

inserting the respective riveting pin/welding pin of the closure element in a respective riveting pin input/welding pin input of a part of the outer slide piece that is detachable during opening of the closure, wherein riveting/welding of the at least one riveting pin/welding pin comprises riveting/welding with the respective riveting pin input/welding pin input.

14. The method according to claim 13, with the further step:

positioning of a safety tape, which breaks during opening of the closure, onto the outer slide piece;

wherein riveting/welding of the at least one riveting pin/welding pin comprises riveting/welding of the safety tape with the at least one riveting pin/welding pin, and also riveting/welding with the respective riveting pin input/welding pin input;

wherein at least two riveting pins/welding pins are provided and riveting/welding of the at least two riveting pins/welding pins comprises riveting/welding of the safety tape with the at least two riveting pins/welding pins.

15. The method according to claim 13, with the further step:

verification of the position of the rivetings/weldings of the at least one riveting pin/welding pin and/or verification of the position of the riveting pin input/welding pin input and/or verification of the position of the safety tape by means of a camera, in particular with an evaluation unit;

with the further step:

checking the outer slide piece and/or of the lid panel and/or of the edge of the lid panel for damages with the camera, in particular with the evaluation unit.

16. The method according to claim 1, with the following further step:

pressurizing the lid by means of a gas to verify the tightness of the lid for at least one pressure value for two different pressure values.

17. The method according to claim 1, wherein the provision of the lid panel comprises the following step:

bulging of the inner area of the lid panel into a convex form in relation to the outer face.

18. The method according to claim 17, further including the following step:

punching the openings in the lid panel prior to the step of bulging of the inner area of the lid panel into a convex form in relation to the outer face.

19. The method according to claim 1, with the following step:

collection of the lids in a stack;

with the further step:

packaging of the lid stack when there is a predefined number of lids in the lid stack.

* * * * *